US008613597B1

(12) United States Patent
Liang

(10) Patent No.: US 8,613,597 B1
(45) Date of Patent: Dec. 24, 2013

(54) TURBINE BLADE WITH TRAILING EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 315 days.

(21) Appl. No.: 13/007,775

(22) Filed: Jan. 17, 2011

(51) Int. Cl.
*F01D 5/18* (2006.01)

(52) U.S. Cl.
USPC ..... 416/97 R

(58) Field of Classification Search
USPC ..... 415/115, 116; 416/95, 96 R, 97 R
See application file for complete search history.

(56) References Cited

U.S. PATENT DOCUMENTS

| | | | | |
|---|---|---|---|---|
| 4,767,268 | A * | 8/1988 | Auxier et al. | 416/97 R |
| 5,403,159 | A * | 4/1995 | Green et al. | 416/97 R |
| 5,931,638 | A * | 8/1999 | Krause et al. | 416/97 R |
| 7,186,082 | B2 * | 3/2007 | Mongillo et al. | 416/1 |
| 2004/0115053 | A1 * | 6/2004 | Shi et al. | 416/97 R |
| 2006/0133936 | A1 * | 6/2006 | Papple | 416/97 R |

* cited by examiner

*Primary Examiner* — Edward Look
*Assistant Examiner* — Danielle M Christensen
(74) *Attorney, Agent, or Firm* — John Ryznic

(57) ABSTRACT

A turbine rotor blade with a trailing edge region cooling circuit that is formed by three rows of ribs each forming a row of metering and impingement holes followed by a series of exit slots each formed with parallel passages that form a metering section followed by a diffusion section. A forward flowing multiple pass serpentine flow cooling circuit cools the mid-chord region and supplies the cooling air for the trailing edge region circuit. A separate leading edge cooling circuit with metering and impingement cooling followed by film cooling cools the leading edge region.

10 Claims, 3 Drawing Sheets

TURBINE BLADE WITH TRAILING EDGE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a large span axial compressor blade of an industrial gas turbine engine.

2. Description of the Related Art Including Information Disclosed Under 37 CFR 1.97 and 1.98

In a gas turbine engine, such as a large frame heavy-duty industrial gas turbine (IGT) engine, a hot gas stream generated in a combustor is passed through a turbine to produce mechanical work. The turbine includes one or more rows or stages of stator vanes and rotor blades that react with the hot gas stream at progressively decreasing temperatures. The efficiency of the turbine—and therefore the engine—can be increased by passing a higher temperature gas stream into the turbine. However, the turbine inlet temperature is limited to the material properties of the turbine, especially the first stage vanes and blades, and an amount of cooling capability for these first stage airfoils.

The first stage rotor blade and stator vanes are exposed to the highest gas stream temperatures, with the temperature gradually decreasing as the gas stream passes through the turbine stages. The first and second stage airfoils (blades and vanes) must be cooled by passing cooling air through internal cooling passages and discharging the cooling air through film cooling holes to provide a blanket layer of cooling air to protect the hot metal surface from the hot gas stream.

Industrial gas turbine (IGT) engines are intended to operate continuously for long periods of time. Inadequate cooling of blades and vanes will cause hot spots to occur and result in erosion damage that decreases the engine performance and shortens the useful life of the parts.

Another difference between industrial gas turbine engine blades and vanes over those used in aero applications is the size of the blades and vanes. A blade or vane used in an IGT engine is quite large compared to the aero engines. The cast these larger airfoils, the cores are typically formed from two or three parts plus tip plugs to cast the inner cooling circuits. This can cause difficulties in casting the blade or vane. Multiple piece cores can result in core shifting that result in defective castings. Also, very small core details can be broken from the liquid metal flowing into and around the core pieces that form the cooling channels and passages. Low yields result in high casting costs since many of the cast parts are defective and must be cast again before an acceptable airfoil is produced. Increasing the casting yields is always a desirable in order to decrease the cost of manufacturing the airfoils.

BRIEF SUMMARY OF THE INVENTION

A turbine rotor blade with two separate cooling circuits to provide cooling for the blade leading edge region and the blade mid-chord and trailing edge regions. The leading edge region is cooled with a radial cooling supply channel connected to a leading edge impingement cavity or cavities through a row of metering and impingement holes. Showerhead film cooling holes and gill holes discharge the spent impingement cooling air as film cooling air for the leading edge region. The mid-chord region is cooled by a triple-pass forward flowing serpentine flow cooling circuit with film holes on the pressure and suction walls and tip cooling holes.

The trailing edge region is cooled using a portion of the cooling air from the serpentine flow circuit to produce multiple metering and impingement cooling in the trailing edge channel followed by metering and diffusion slots arranged along the trailing edge of the blade.

The trailing edge region metering flow control design improves ceramic core breakage modes such as shear, local edge bending and overall trailing edge bending to achieve a stiffer trailing edge ceramic core which minimizes core breakage during casting process to improve casting yields. Also, tailoring of the cooling flow to the blade mainstream hot gas temperature profile can be achieved.

DETAILED DESCRIPTION OF THE INVENTION

The turbine rotor blade of the present invention includes a blade cooling circuit with an enhanced trailing edge cooling flow control design that is used for industrial gas turbine engines and is shown in FIGS. 1 through 4. An innovative structural arrangement of internal heat transfer mechanisms is provided to achieve durability goals of a modern technology IGT engine. Several heat transfer devices are integrated into the blade design of the present invention to produce a one piece structure where normally two or three parts plus tip plugs are required in blade casting of this complexity. The cooling design of the present invention uses an airfoil trailing edge cooling design that can be used in the blade cooling design where the airfoil trailing edge incorporates double or triple impingement cooling. The cooling circuit design for the blade will allow for an increased durability high strength turbine blade, a more effective use of cooling air, improved means of controlling and directing the trailing edge region cooling air, and an improved means for manufacturing the blade.

Figure 1:
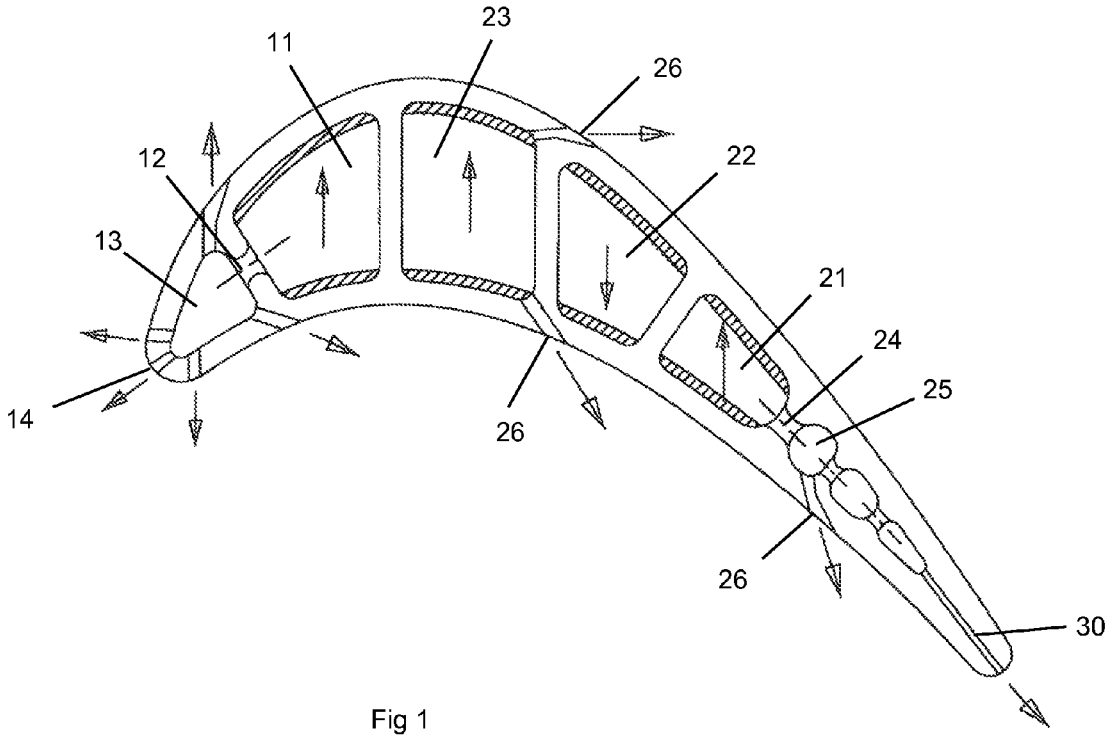
FIG. 1 shows a cross section top view of a blade cooling circuit of the present invention.

Cooling for the blade is produced using two separate cooling air circuits with the first in the leading edge region and the second in the mid-chord and trailing edge regions. FIG. 1 shows the blade with the first cooling circuit including a leading edge (LE) region cooling air supply channel 11, a row of metering and impingement holes 12, and a LE impingement cavity 13 located along the LE of the blade. The LE impingement cavity 13 is connected to the LE cooling supply channel 11 through the metering and impingement holes 12. A showerhead arrangement of film cooling holes 14 are connected to the LE impingement cavity 13 along with PS (Pressure Side) and SS (Suction Side) gill holes to discharge the spent impingement cooling air as layers of film cooling air.

The second cooling circuit includes a multiple pass serpentine flow cooling circuit to cool the mid-chord region of the blade and a multiple metering and impingement cooling circuit to cool the trailing edge (TE) region of the blade. In one embodiment of the present invention, a forward flowing three-pass serpentine flow cooling circuit is used and includes a first leg or channel 21 located adjacent to the TE region of the blade to supply cooling air. A second leg or channel 22 connects the first leg 21 to a third leg or channel 23 located adjacent to the LE region cooling circuit. Rows of film cooling holes 26 on the pressure side (PS) and the suction side (SS) of the blade are connected to the third leg 23 of the three-pass serpentine flow circuit.

Figure 2:
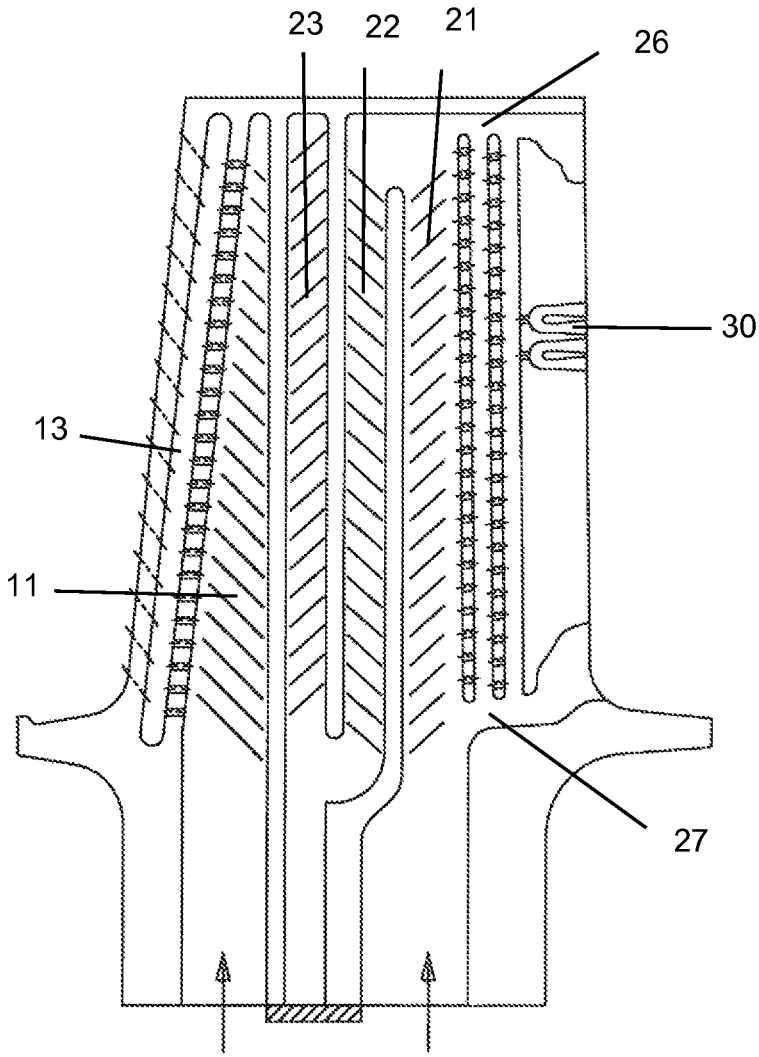
FIG. 2 shows a cross section side view of a blade cooling circuit of the present invention.

The TE region cooling circuit includes multiple metering and impingement cooling circuits followed by TE cooling slots. A first row of metering holes 24 is connected to the first leg 21 of the three-pass serpentine flow circuit. The first row of metering holes 24 discharge into an impingement channel 25 that extends along a spanwise direction of the blade from the platform to the blade tip as seen in FIG. 2. A second row of metering and impingement holes 24 connects the first impingement channel 25 to a second impingement channel located downstream. A third row of metering and impingement holes 24 is formed in an entrance section of the cooling slots 30.

Figure 3:
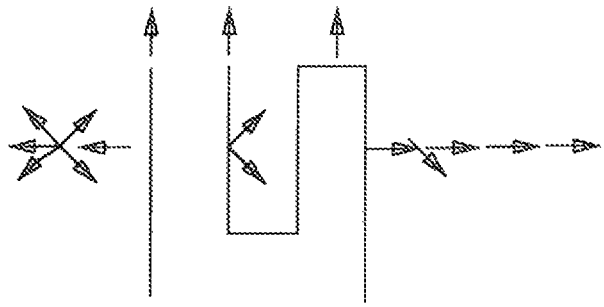
FIG. 3 shows a flow diagram for the cooling circuit of the present invention.

FIG. 2 shows a side view of the cooling circuit. The metering holes 24 are formed in ribs that extend along the trailing edge region cooling channel from the platform to the blade tip. The radial channels formed on the downstream sides of the ribs forms the impingement channels 25. FIG. 3 shows a flow diagram of the cooling circuit of FIG. 2. Cooling air flows through tip cooling holes at the turn between the first and second legs 21 and 22, at the end of the third leg 23, and at the end of the LE impingement cavity 13 to provide cooling for the blade tip. Skewed trip strips are used on the inside walls of the cooling channels and cavities to enhance the effectiveness of the heat transfer of the cooling air flow.

As seen in FIG. 2, continuous flow channels at the tip 28 and at the platform 27 are formed between the end of the ribs that formed the metering holes and the inner surface of the blade tip or the platform so that cooling air can flow around the ends of the ribs. This also forms ceramic core supports for the pieces that form the trailing edge impingement and metering holes and exit slots during the casting process.

Figure 4:
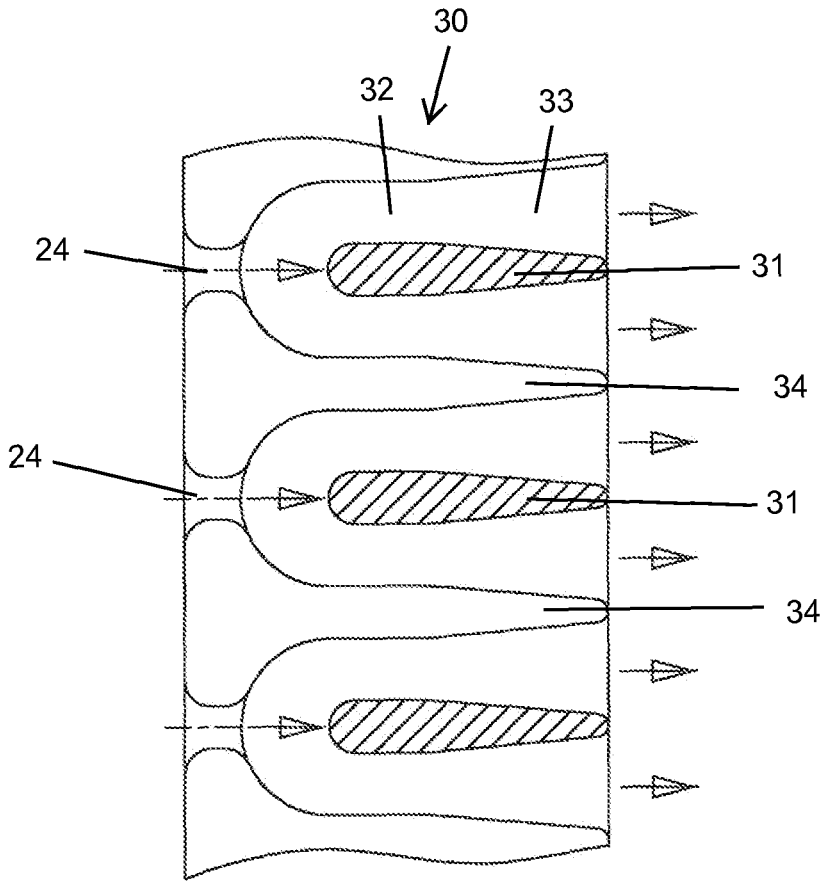
FIG. 4 shows a detailed cross section side view of a section of the trailing edge region cooling circuit of the present invention.

The TE region of the blade is also cooled with a row of TE cooling slots 30 that are formed by ribs extending along the TE end of the TE cooling channel formed between the PS and SS walls. FIG. 4 shows a detailed view of a section of these cooling slots 30. An impingement metering hole 24 (formed in a third rib) opens into cooling passages formed by ribs 31 that extend chordwise and form parallel paths from an inlet end to an outlet end. Two outer ribs 34 form an enclosed path with an inner rib 31 separating the enclosed path into two parallel paths.

The two parallel paths formed around the inner rib 31 form a constant cross sectional flow area 32 and a diffusion flow area 33 located downstream in the direction of the cooling air flow. The inner ribs 31 and the outer ribs 34 have slanted surfaces of 3 to 5 degrees to form the diffusion sections. The impingement metering holes 24 are aligned to direct the cooling air to impinge on to the inner ribs 31 and then flow around then and into the two parallel passages formed with the constant flow area 32 and the diffusion flow area 33.

The LE flow circuit provides cooling for the LE region of the blade which is a critical part of the blade from a durability issue. Cooling air is fed into the airfoil through a single pass radial cooling supply channel 11. Skewed trip strips are used on the PS and SS inner walls of the cooling channels to enhance the internal heat transfer performance. Multiple impingement jets of cooling air through the row of cross-over holes (metering and impingement holes 12) from the cooling supply channel 11 produce backside impingement cooling for the LE inner surface of the blade. The cross-over holes 12 are designed to support the LE ceramic core during casting of the blade, including the removal of the ceramic core material during the manufacturing period using a leaching process. The spent impingement cooling air is then discharged through a series of small diameter showerhead film cooling holes at a relative angle to the LE surface of the blade. A portion of the cooling air is also discharged through rows of PS and SS gills holes located downstream from the showerhead film cooling holes 14. Thus, a combination of impingement cooling, convection cooling and film cooling is produced for the LE region of the blade that will maintain this section of the blade with acceptable levels of blade LE metal temperature. In another embodiment, the LE impingement cavity can be formed as a series of separate compartment impingement cavities extending in the radial or spanwise direction that will allow for additional control to regulate the pressure ratio across the LE showerhead and therefore eliminate the showerhead film hole blow-off problem and achieve optimum cooling performance with an adequate backflow pressure margin (backflow is when the internal pressure is low enough to allow for the hot gas to flow into the blade through the cooling holes) and a minimum cooling air flow.

The cooling flow circuit for the mid-chord region is supplied through a separate opening and cooling air flows forward through a triple-pass serpentine flow circuit. The partition ribs that form the serpentine flow channels are arranged to provide for a high structural integrity, a proper flow area and pressure drop design, and a means for supporting the ceramic cores during the casting process so that the blade can be made as one piece. A series of trip strips are used within the serpentine flow channels to enhance the blade internal heat transfer performance. Cooling air serpentine through the cooling channels and is then discharged through compound oriented multiple diffusion film cooling holes on the blade PS and SS walls as well as in the integrally cast blade tip surface. A half root turn cooling flow design is used in the triple-pass serpentine circuit. The serpentine core is extended from the half root turn to the blade inlet region for core support and possible future cooling air addition.

The tip section of the blade is designed to be integrally cast with the rest of the blade structure. No bonded covers or attachment caps are required for the tip enclosure. Specially arranged core print out provides adequate tip core support for the serpentine ceramic core structure such as to prevent core shifting during the casting process. A simple plug weld is made in each of the core print out to completely close the tip surface. An array of film cooling holes placed near the edge of the PS tip surface provides adequate cooling of the tip section to control the metal temperature.

In the blade TE region, a portion of the cooling air from the mid-chord serpentine flow channel that forms the cooling air feed channel 21 is discharged through a series of metering and impingement cooling holes. In one embodiment, three rows of metering and impingement holes are used for the TE region. Cooling air is directed into a rear cavity through a series of small metering holes optimized for castability and cooling requirements. The spent cooling air then flows through another series of metering orifices at a staggered arrangement with respect to the upstream metering holes.

This flow metering process is repeated until the cooling air is finally discharged from the blade TE through a series of cooling slots. Use of this particular type of cooling flow control yields an optimum cooling flow distribution for a high pressure ratio across the airfoil or across the airfoil TE section. A typical cooling air pressure ratio across the entire TE is around 1.6 with the multiple metering flow control to decrease the cooling pressure ratio to around 1.125 across each row of metering holes. If the pressure ratio across each row of metering holes is too high, then the cooling flow will be very sensitive to the metering hole geometry variations. If the pressure ratio across the metering row is too low, then the metering hole geometry will have very little control of the cooling flow.

The TE cavities and the associated metering holes are designed with the consideration of both heat transfer effectiveness and castability, including leaching the ceramic core material after casting as well as the formation requirement for the ceramic core stiffness in the manufacturing process. The multiple impingement cooling holes are at a staggered array formation. However, the third row of impingement cooling holes is integrated with the TE exit bleed slots. With this cooling design, spanwise cooling flow control is achieved by those individual components. Cooling flow distribution can be tailored into the airfoil external hot gas heat load and pressure profile. The exit cooling slots can also function as a ceramic core support during the casting process.

I claim the following:

1. A turbine rotor blade comprising:

a leading edge region and a mid-chord region and a trailing edge region;

a multiple pass forward flowing serpentine flow cooling circuit in the mid-chord region with a first leg located adjacent to the trailing edge region;

a plurality of ribs extending in a spanwise direction of the blade and from near a platform to near a blade tip of the blade, the ribs forming first and second rows of metering and impingement holes;

a row of trailing edge exit slots extending along the trailing edge of the blade and connected to the rows of metering and impingement holes through a third row of metering and impingement holes;

the trailing edge exit slots are each formed with a metering section followed by a diffusion section; and, the trailing edge exit slots are each formed by two outer ribs and one inner rib with the inner and outer ribs having slanted surfaces that form two diffusion sections.

2. The turbine rotor blade of claim 1, and further comprising:

the slanted surfaces are angled from three to five degrees.

3. The turbine rotor blade of claim 1, and further comprising:

the third row of metering and impingement holes are aligned with the inner ribs such that impingement cooling is produced on the inner ribs.

4. The turbine rotor blade of claim 1, and further comprising:

the trailing edge exit slots are each formed with two parallel passages each with a metering section and a diffusion section.

5. The turbine rotor blade of claim 1, and further comprising:

the multiple pass forward flowing serpentine flow cooling circuit is a triple-pass serpentine flow circuit.

6. The turbine rotor blade of claim 1, and further comprising:

the leading edge region is cooled with a cooling air supply channel connected to a leading edge impingement cavity through a row of metering and impingement holes; and, a showerhead arrangement of film cooling holes connected to the leading edge impingement cavity.

7. A turbine rotor blade comprising:

an airfoil with a pressure side wall and a suction side wall and a trailing edge region;

a cooling air supply channel located adjacent to the trailing edge region;

a row of metering and impingement holes connected to the cooling air supply channel to supply cooling air to the row of metering and impingement holes;

a plurality of metering and diffusion slots connected to the row of metering and impingement holes;

each of the metering and diffusion slots having a middle rib aligned with a metering and impingement hole to produce impingement cooling of a forward side of the middle rib;

each of the metering and diffusion slots forming a separate cooling air flow passage from the metering and impingement hole to an exit slot; and, the middle rib separating the metering and diffusion slot into two parallel flow paths.

8. The turbine rotor blade of claim 7, and further comprising:

each of the metering and diffusion slots includes a metering section followed by a diffusion section.

9. The turbine rotor blade of claim 8, and further comprising:

the diffusion section is formed with slanted surfaces from 3 to 5 degrees.

10. The turbine rotor blade of claim 7, and further comprising:

the cooling air supply channel is a first leg of a multiple pass forward flowing serpentine flow cooling circuit.

* * * * *